US012005299B2

(12) United States Patent
Way

(10) Patent No.: US 12,005,299 B2
(45) Date of Patent: Jun. 11, 2024

(54) EXERCISE MAT WITH TEXTURED INSERTS

(71) Applicant: Courtney Way, Airdrie (CA)

(72) Inventor: Courtney Way, Airdrie (CA)

( * ) Notice: Subject to any disclaimer, the term of this patent is extended or adjusted under 35 U.S.C. 154(b) by 0 days.

(21) Appl. No.: 17/829,079

(22) Filed: May 31, 2022

(65) Prior Publication Data

US 2022/0379162 A1 Dec. 1, 2022

(30) Foreign Application Priority Data

Jun. 1, 2021 (CA) ..... CA 3120419

(51) Int. Cl.
*A63B 21/00* (2006.01)

(52) U.S. Cl.
CPC ..... *A63B 21/4037* (2015.10); *A63B 2213/00* (2013.01)

(58) Field of Classification Search
CPC ..... A63B 21/4037; A63B 2213/00; A63B 2071/0694; A63B 2209/10; A63B 2210/50; A63B 21/4039; A63B 21/4035; A63B 69/0057
See application file for complete search history.

(56) References Cited

U.S. PATENT DOCUMENTS 1,981,379 A * 11/1934 Thomson ..... A63B 23/10 601/28
2,465,725 A * 3/1949 Herzmark ..... A61H 7/00 482/79
2,820,454 A * 1/1958 Wright ..... A61H 7/001 482/79
3,744,483 A * 7/1973 Picolin ..... A61H 7/001 4/581
4,210,134 A * 7/1980 Okazaki ..... A61H 39/06 601/134
4,329,981 A * 5/1982 Dungl ..... A61H 7/001 601/28
4,350,152 A * 9/1982 Strakowski ..... A61H 1/008 601/1
5,096,188 A * 3/1992 Shen ..... A61H 7/001 601/134
D409,753 S * 5/1999 Affholter ..... D24/188
6,387,013 B1 * 5/2002 Marquez ..... A63B 6/00 473/278
6,491,196 B1 * 12/2002 Coler ..... A45F 3/14 224/648
D471,636 S * 3/2003 Yu ..... D24/212
6,579,250 B2 * 6/2003 Robbins, III ..... A47G 27/0231 601/138
6,640,359 B1 * 11/2003 Alane ..... A47G 27/0237 5/420
D490,530 S * 5/2004 Chen ..... D24/212
(Continued)

*Primary Examiner* — Garrett K Atkinson
(74) *Attorney, Agent, or Firm* — Berg Hill Greenleaf Ruscitti LLP

(57) ABSTRACT

An exercise mat comprising: a base layer; a top layer comprising at least one pre-determined removable mat layer section; and at least one textured insert adapted for insertion into a gap in said top layer, wherein said gap is defined by the removal of said at least an one pre-determined removable mat layer section; wherein said at least one textured insert provides for a tactile sensation when a user applies pressure thereonto.

10 Claims, 2 Drawing Sheets

(56) References Cited

U.S. PATENT DOCUMENTS 6,742,289 B2 * 6/2004 Celmo ..... A61H 39/04 36/43
D496,110 S * 9/2004 Kim ..... D24/212
6,821,260 B2 * 11/2004 Fors ..... A61H 39/04 601/134
7,107,626 B1 * 9/2006 Andrews ..... A41B 11/004 2/239
7,108,635 B2 * 9/2006 Howlett-Campanella ..... A63B 21/4037 D21/797
7,485,102 B2 * 2/2009 Zake ..... A61H 15/00 601/134
7,819,777 B1 * 10/2010 Service ..... A63B 21/4037 482/907
8,025,606 B2 * 9/2011 Hamilton ..... A63B 23/0244 482/148
D649,653 S * 11/2011 Halvorsen ..... D24/215
8,220,087 B2 * 7/2012 Villa ..... A63B 21/4037 482/142
8,317,660 B2 11/2012 Goranson
8,801,530 B2 * 8/2014 Beck ..... A63B 71/0622 473/201
8,961,372 B2 * 2/2015 Hasta ..... A47G 9/062 5/420
8,966,681 B2 * 3/2015 Burch ..... A63B 21/4037 5/907
9,295,872 B2 * 3/2016 Martens ..... A63B 21/072
9,738,059 B2 8/2017 Hing
9,950,208 B2 * 4/2018 Willis ..... A63B 21/4037
D819,824 S * 6/2018 Moehlenbrock ..... D24/211
D822,221 S * 7/2018 Huth ..... D24/211
10,315,065 B1 * 6/2019 Soba ..... A63B 21/151
10,493,350 B2 * 12/2019 DeMarch ..... G09B 19/003
D878,497 S * 3/2020 Miles ..... D6/582
D878,604 S * 3/2020 Chapman ..... D24/188
10,646,762 B2 * 5/2020 Bowers ..... A63B 63/00
D890,270 S * 7/2020 Patel ..... D21/686
10,933,277 B2 * 3/2021 Calvaruso ..... A63B 21/4037
D943,304 S * 2/2022 Mross ..... D6/582
D969,516 S * 11/2022 Mross ..... D6/582
2004/0088788 A1 * 5/2004 Alane ..... A47G 27/0237 5/420
2004/0250346 A1 * 12/2004 Vasishth ..... A47G 27/0237 5/420
2004/0261289 A1 * 12/2004 Lindsay ..... A43B 7/142 36/11.5
2005/0239604 A1 * 10/2005 Denham ..... A63B 21/4037 482/148
2006/0035774 A1 * 2/2006 Marks ..... A63B 71/0686 482/148
2007/0020449 A1 * 1/2007 Hing ..... A63B 21/4037 428/318.4
2007/0057460 A1 * 3/2007 Swaab ..... A63B 21/4037 273/259
2007/0066467 A1 * 3/2007 Edwards ..... B32B 5/18 482/148
2007/0233506 A1 * 10/2007 Moore ..... G06Q 50/265 705/325
2008/0005947 A1 * 1/2008 Barna ..... A63B 69/3661 40/629
2009/0181836 A1 * 7/2009 Schneider ..... A63B 6/00 482/141
2010/0048356 A1 * 2/2010 Hamilton ..... A63B 21/4037 482/4
2010/0299833 A1 * 12/2010 Kessler ..... A63B 21/4037 5/417
2011/0070569 A1 * 3/2011 Martens ..... A63B 21/072 482/92
2011/0072581 A1 * 3/2011 Villa ..... A63B 21/4037 5/420
2011/0111926 A1 * 5/2011 Goranson ..... A63B 6/00 482/23
2012/0015334 A1 * 1/2012 Hamilton ..... A63B 71/0622 434/247
2012/0233772 A1 * 9/2012 Wang ..... A63B 21/4037 5/417
2012/0295723 A1 * 11/2012 Beck ..... A63B 71/0622 473/549
2012/0304382 A1 * 12/2012 Sole ..... A47G 27/0206 5/487
2013/0190151 A1 * 7/2013 Scholder ..... A63B 21/4039 482/142
2013/0324382 A1 * 12/2013 Wilson ..... A61H 7/007 482/142
2014/0329044 A1 * 11/2014 Fantin ..... B32B 7/12 428/71
2015/0101123 A1 * 4/2015 Robo ..... A63B 21/4037 5/417
2015/0126340 A1 * 5/2015 White ..... A63B 21/06 482/93
2015/0367158 A1 * 12/2015 Pretz ..... A63B 21/0557 482/129
2016/0030800 A1 * 2/2016 McClure ..... A63B 22/16 482/146
2017/0100652 A1 * 4/2017 Bowers ..... A63B 63/08
2018/0257832 A1 * 9/2018 Loeffler ..... A63B 21/4037
2019/0038950 A1 * 2/2019 Jensen ..... A63B 69/0002
2019/0233992 A1 * 8/2019 Ziadeh ..... A63C 11/228
2019/0262658 A1 * 8/2019 Salamone ..... A63B 21/4037

* cited by examiner

EXERCISE MAT WITH TEXTURED INSERTS

FIELD OF THE INVENTION

The present invention is directed to a novel exercise mat, more specifically, it is directed to a mat adapted to receive textured inserts to allow for a combined exercise therapy.

BACKGROUND OF THE INVENTION

Touch receptors, which are located on the skin, allow individuals to interpret textures and other things such as heat or pain. Tactile sensitivity or hypersensitivity is an unusual or increased sensitivity to touch which may affect individuals to feel person feel peculiar, noxious, or even in pain. It is also called tactile defensiveness or tactile over-sensitivity. Like other sensory processing issues, tactile sensitivity can run from mild to severe. It is thought to be caused by the way the brain processes tactile input. For these individuals, touch makes the person feel overwhelmed and often leads to avoiding touch when possible.

Individuals afflicted to greater or lesser extent of tactile hypersensitivity display a heightened sensitivity to a variety of seemingly benign textures, such as foods, fabrics, and various types of surfaces. Such individuals may be irritated with the simple notion of a hug or various fabrics.

Tactile hypersensitivity is more often found in individuals on the autism spectrum. Such individuals having cognitive disabilities often display tactile hypersensitivity as it can be a primary source of sensory overload. Sensory overload episodes can lead to situations where the individuals displays an increased irritated behavior or even worse, in meltdowns.

There are well known irritants which will trigger erratic behavior in individuals as a results of tactile hypersensitivity. These vary from individual to individual but can include things such as: the dislike of clothing, shoes, hats, mittens; the dislike of having one's hair combed, washed, or cut; the refusal to swallow food or drink; tickling; being touched; being held; participating in various physical activities.

While these behaviors may seem extreme to someone who does not experience sensory issues, these behaviors are a direct result of how the brains process sensory information. Several objects such as fabrics or textured surfaces are used in dealing with an individual's hypersensitivity.

It is well known that tactile oversensitivity also interferes with the development of fine motor and gross motor skills. Unless, efforts are made to address tactile oversensitivity, this delay may cause further problems in an individual's development.

Once an individual has been diagnosed as having some level of tactile hypersensitivity, adaptive treatment can begin under the care of an occupational therapist. An approach to deal with an individual with tactile hypersensitivity can be put in place by resorting to a number of tactics designed to help an individual cope and overcome with success the condition. Occupational therapy with a tactile-sensory integration approach typically takes place in a sensory-rich environment under the supervision of a qualified individual. Over time and by following the predetermined approach, an individual can achieve substantially decreased tactile sensitivity and pursue motor skills development.

The incorporation of calm and controlled exercises can be used as part of the approach proposed by an occupational therapist. These include stretching, basic yoga and other similar exercises performed on an exercise mat under a space controlled atmosphere where contact with other individuals is virtually eliminated.

In that respect, there are a variety of exercise mats which exist and are commercially available which incorporate a variety of features. These include:

U.S. Pat. No. 8,961,372B2 teaches apparatuses and methods for assisting users to align and place limbs to perform various yoga positions. Apparatuses and method disclosed herein comprise a towel or mat having markings (e.g., lines, dots, circles, or any other indication) to help a user align and place the user's limbs. Some of the markings can be used to measure distances as some of the markings are a predetermine distance apart.

U.S. Pat. No. 9,738,059B2 teaches exercise mats, systems of exercise mats, and related methods of making and/or using the same are provided herein. It is stated that the subject matter disclosed herein relates to exercise mats, such as yoga mats, and systems of exercise mats that provide visual cues and/or different levels of tackiness to provide different levels of grip to optimize a user's connection to the mat and methods related to the exercise mats.

U.S. Pat. No. 8,317,660B2 teaches a mat for learning, teaching, and performing yoga in which the upper surface of the mat includes visually discernable floor-contacting body part markings. Sets of the markings can be used by yoga practitioners to facilitate proper positioning for one or more yoga poses. In another aspect of the invention, mats can be made for practitioners of different sizes and abilities by varying the spacing of the sets of markings for the poses. It states that an image of the mat can be represented on another medium, such as a card, poster, or video, on which a pose is depicted and the representations of the markings of the mat for that pose can be highlighted.

U.S. Pat. No. 9,950,208B2 teaches a system comprising a yoga mat, storage compartment and carrying case and associated methods for use.

In light of the state of the art, there still exists a need for an exercise mat which can be adapted for various uses all the while providing the option of inserting tactile features which can be used for massage or tactile sensitivity training purposes.

SUMMARY OF THE INVENTION

Despite the numerous types of exercise mats or yoga mats disclosed or commercially available, there are no mats which allow a user to introduce a tactile sensitive individual to exercise while allowing the incorporation of textures in a safe and controlled manner.

According to an aspect of the present invention, there is provided an exercise mat comprising:

- a base layer;
- a top layer comprising at least one pre-determined removable mat layer section; and
- at least one textured insert adapted for insertion into a gap in said top layer, wherein said gap is defined by the removal of said at least an one pre-determined removable mat layer section;

wherein said at least one textured insert provides for a tactile sensation when a user applies pressure thereonto.

According to a preferred embodiment of the present invention, the at least one textured insert has a convex shape which allows a top surface of the insert to be above a plane defined by the top layer of the mat when the insert is in place inside the gap in said top layer.

According to a preferred embodiment of the present invention, the at least one textured insert has a circular shape adapted for insertion into a circular gap present in the top layer of the mat once a removable mat layer section is removed therefrom.

According to another aspect of the present invention, there is provided a kit comprising:

an exercise mat comprising:

a base layer;

a top layer comprising at least one pre-determined removable mat layer section; and at least one textured insert adapted for insertion into a gap in said top layer, wherein said gap is defined by the removal of said at least an one pre-determined removable mat layer section;

wherein said at least one textured insert provides for a tactile sensation when a user applies pressure thereonto.

Preferably, the insert is made of a lightweight material such as foam or soft plastic. According to a preferred embodiment, the insert, once in place, does not extend beyond the plane defined by the surface of the top layer. This allows a user to file the mat and use the 'bottom' side to perform exercises while the inserts are still in place on the top layer, which is now facing the floor. In other instances, where the inserts are designed to protrude above the plane defined by the surface of the top layer of the mat, it is recommended that when a user wants to use the bottom layer of the mat to exercise, i.e. wants to flip the mat over, one should remove the inserts prior to flipping the mat over.

According to a preferred embodiment of the present invention, the insert can be maintained in place by a friction-fit with the surrounding top layer. According to another preferred embodiment of the present invention, the insert can be maintained in place by a securing means located on the bottom layer of the mat inside the gap. Preferably, the securing means can be Velcro, where one of the two Velcro parts is located in the gap on the bottom layer of the mat and the other Velcro part is located on an underside of the textured insert. Any other equivalent means of securing said insert on the mat for use and easy removal of the insert after use is considered to fall within the definition of securing means as used in the present description.

According to a preferred embodiment of the present invention, the pre-determined removable mat layer sections are evenly distributed on the mat surface. Preferably, depending on the length and width of said mat, there can be one, two or three inserts per row and up to five or six rows on a standard yoga mat size exercise mat.

According to a preferred embodiment, there is one type of textured insert that can provide a pre-determined sensation for a user. Preferably, the textured inserts may comprise a series of concentric circles, a series of wavy lines, a series of short soft spikes, a series of hemispheres, or a combination thereof.

BRIEF DESCRIPTION OF THE FIGURES

The present invention may be more completely understood in consideration of the following description of various embodiments of the invention in connection with the accompanying figures, in which.

DESCRIPTION OF THE INVENTION

According to an aspect of the present invention, there is provided a kit comprising:

an exercise mat comprising:

a base layer;

a top layer comprising at least one pre-determined removable mat layer section; and at least one textured insert adapted for insertion into a gap in said top layer, wherein said gap is defined by the removal of said at least an one pre-determined removable mat layer section;

wherein said at least one textured insert provides for a tactile sensation when a user applies pressure thereonto.

Figure 1:
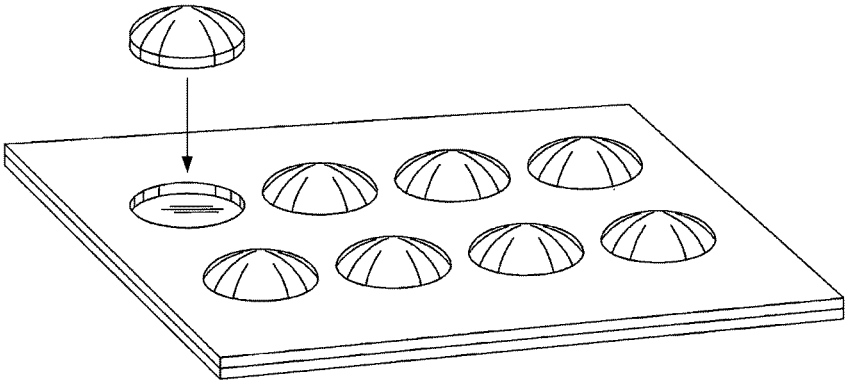
FIG. 1 is a perspective view of an exercise mat according to a preferred embodiment of the present invention with several inserts put in gaps on the top layer of the mat.
Figure 2:
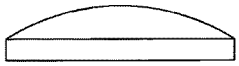
FIG. 2 is a side view of a convex insert according to a preferred embodiment of the present invention.
Figure 3:
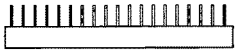
FIG. 3 is a side view of an insert covered in soft spikes according to a preferred embodiment of the present invention.
Figure 4:
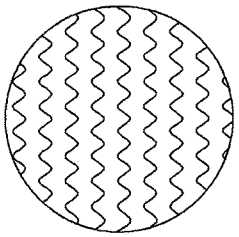
FIG. 4 is a top view of a textured insert having a wavy pattern on its surface according to a preferred embodiment of the present invention.
Figure 5:
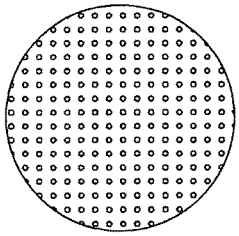
FIG. 5 is a top view of a textured insert having a dot pattern on its surface according to a preferred embodiment of the present invention.

As can be seen in FIG. 1, an exercise mat according to a preferred embodiment of the present invention with several inserts put in gaps on the top layer of the mat. Upon use, the user selects the type of textured inserts desired and removes the at least one pre-determined removable mat layer section and inserts any one of the various textured inserts.

Preferably, the kit comprises a stacking system to put away the various inserts. Even more preferably, the stacking system has a cylindrical shape around which a user can roll the mat after use. This is especially convenient to transport the mat and the various inserts.

Figure 7:
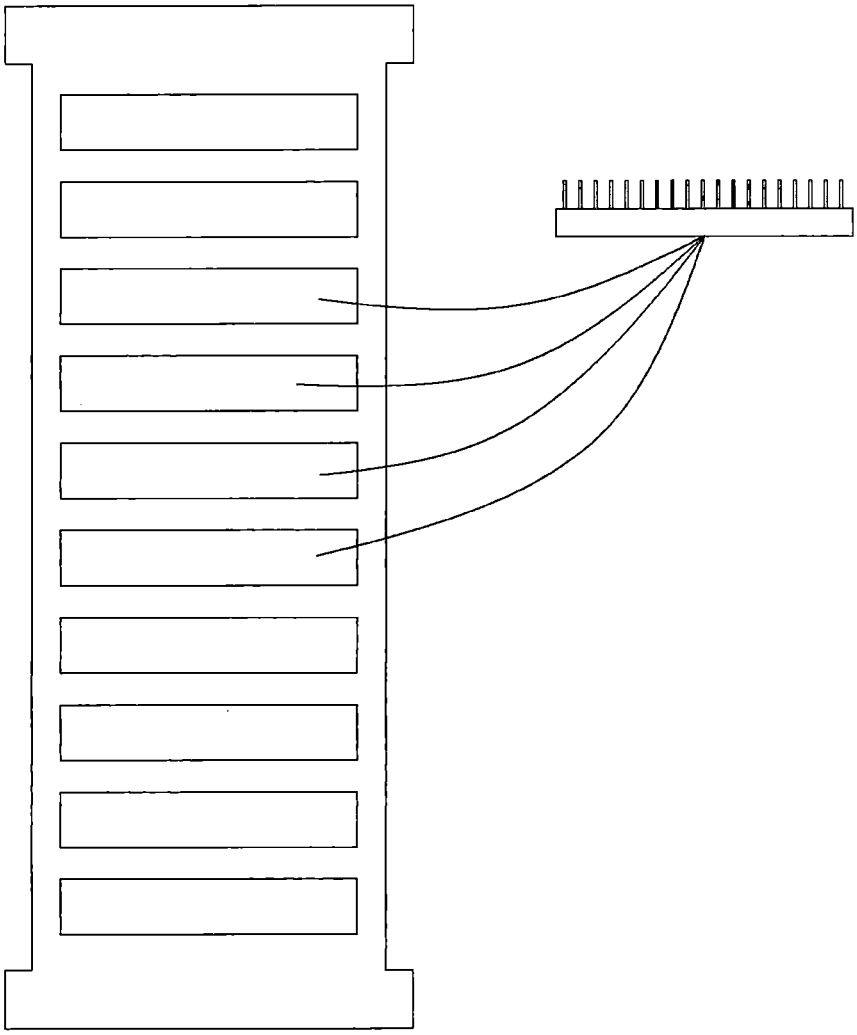
FIG. 7 is a front view of the cylindrical tube having a plurality of slot-like compartments for the insertion of textured inserts according to a preferred embodiment of the present invention.

The user can store the at least one pre-determined removable mat layer section into the slot-like compartments provided for on the cylindrical storage tube (See FIG. 7). Once the exercise session completed, the user can remove the various inserts from the exercise mat and replace them with the at least one pre-determined removable mat layer section. The user can then store the inserts into the cylindrical storage tube where they are held in place through the use of any one of retaining means.

Figure 8:
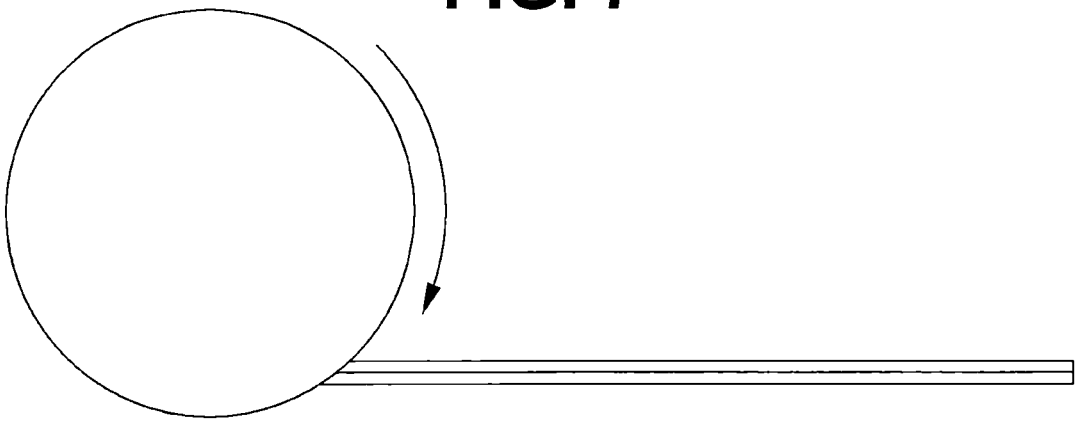
FIG. 8 is a side view of the exercise mat being rolled up with the cylindrical tube according to a preferred embodiment of the present invention.

As best seen in FIG. 7, the cylindrical storage tube can comprise a top and bottom edge which is specifically designed to help the user roll up the mat after the exercise session. FIG. 8 is a side view of the exercise mat being rolled up with the cylindrical tube according to a preferred embodiment of the present invention. Securing means such as an elastic or any other similar securing means can be used to keep the mat tightly rolled up.

Figure 6:
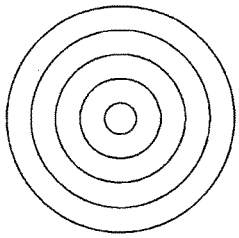
FIG. 6 is a top view of a textured insert having a number of concentric circles on its surface according to a preferred embodiment of the present invention.

FIGS. 2 to 6 display a variety of textured inserts for use with a mat as depicted in FIG. 1 for example. These inserts include convex inserts (FIG. 2), an insert covered in soft spikes (FIG. 3); a textured insert having a wavy pattern on its surface (FIG. 4); a textured insert having a dot pattern on its surface (FIG. 5); a textured insert having a number of concentric circles on its surface (FIG. 6).

According to a method of using the exercise according to a preferred embodiment of the present invention, there is provided a method which comprises the following steps:

unrolling the mat with the top layer comprising at least one pre-determined removable mat layer section facing up; and removing at least one pre-determined removable mat layer section;

inserting into a gap created by the removal of at least one pre-determined removable mat layer section at least one at least one textured insert adapted for insertion into said gap in said top layer;

wherein said at least one textured insert provides for a tactile sensation when a user applies pressure thereonto.

According to one aspect of the present invention, the exercise mat is used to help individuals with tactile sensitivities perform exercise as they are encouraged to perform exercise and feel the various textures present on the mat where inserts have been placed. This provides for an engaging activity and possible improvement in behavior in individuals affected with tactile hypersensitivity.

According to one aspect of the present invention, the exercise mat is used to help individuals perform stretching or other exercises all the while providing various surfaces (or surface areas) which may be used to massage a specific body part.

While the foregoing invention has been described in some detail for purposes of clarity and understanding, it will be appreciated by those skilled in the relevant arts, once they have been made familiar with this disclosure that various changes in form and detail can be made without departing from the true scope of the invention in the appended claims.

The invention claimed is:

1. An exercise mat kit comprising:

an exercise mat comprising:

a base layer;

a top layer comprising at least one pre-determined removable mat layer section; and at least one textured insert adapted for insertion into a gap in said top layer, wherein said gap is defined by the removal of said at least one pre-determined removable mat layer section, wherein said textured insert is maintained in place by a friction-fit with the top layer;

wherein said at least one textured insert provides for a tactile sensation when a user applies pressure thereonto;

a cylindrical tube; and securing means located around said exercise mat wherein the exercise mat is rolled up around an outer surface of the cylindrical tube, and said cylindrical tube maintains said exercise mat in place after being rolled up; and at least one space formed on an outer surface of said cylindrical tube and adapted to store said at least one textured insert when said at least one textured insert is not in use.

2. The exercise mat kit according to claim 1 wherein the at least one textured insert has a convex shape which allows a top surface of the insert to be above a plane defined by the top layer of the mat when the insert is in place inside the gap in said top layer.

3. The exercise mat kit according to claim 1 wherein the at least one textured insert has a circular shape adapted for insertion into the gap present in the top layer of the mat once a removable mat layer section is removed therefrom.

4. The exercise mat kit according to claim 1, wherein the at least one textured insert is made of a lightweight material including foam.

5. The exercise mat kit according to claim 1, wherein the at least one textured insert is maintained in place by a securing means located on the bottom layer of the mat inside the gap.

6. The exercise mat kit according to claim 5, wherein the securing means is hook and pile material.

7. The exercise mat kit according to claim 1 wherein the pre-determined removable mat layer sections are evenly distributed on the mat surface.

8. The exercise mat kit according to claim 1 wherein the at least one textured insert comprises at least one of the following features: a series of concentric circles, a series of wavy lines, a series of short soft spikes, a series of hemispheres, or a combination thereof.

9. The exercise mat kit according to claim 1, wherein said at least one space is a slot shaped compartment.

10. The exercise mat kit according to claim 1, wherein the at least one textured insert is made of a lightweight material including soft plastic.

* * * * *